US008195078B2

(12) United States Patent
Yuyama

(10) Patent No.: US 8,195,078 B2
(45) Date of Patent: Jun. 5, 2012

(54) PROCESSING METHOD OF WASTE TONER AND PROCESSING DEVICE OF WASTE TONER AND IMAGE FORMING DEVICE

(75) Inventor: Takeshi Yuyama, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 342 days.

(21) Appl. No.: 12/558,161

(22) Filed: Sep. 11, 2009

(65) Prior Publication Data

US 2010/0067964 A1 Mar. 18, 2010

(30) Foreign Application Priority Data

Sep. 12, 2008 (JP) ..... 2008-234925

(51) Int. Cl.
*G03G 21/00* (2006.01)

(52) U.S. Cl. ..... 399/358; 399/35; 399/98; 399/99; 399/360

(58) Field of Classification Search ..... 399/35, 399/98, 99, 358, 360
See application file for complete search history.

(56) References Cited

U.S. PATENT DOCUMENTS

| | | | | |
|---|---|---|---|---|
| 5,223,543 | A * | 6/1993 | Iovino | 521/44.5 |
| 5,549,839 | A * | 8/1996 | Chandler | 510/365 |
| 6,031,142 | A * | 2/2000 | Ponsford et al. | 585/241 |
| 6,890,437 | B2 * | 5/2005 | Rickett et al. | 210/510.1 |
| 2007/0122181 | A1 * | 5/2007 | Kamijo et al. | 399/101 |
| 2008/0069618 | A1 * | 3/2008 | Ishino et al. | 399/360 |

FOREIGN PATENT DOCUMENTS

| | | | |
|---|---|---|---|
| JP | 60184277 | A * | 9/1985 |
| JP | 2000192049 | A * | 7/2000 |
| JP | 2001-134010 | | 5/2001 |
| JP | 3227199 | | 8/2001 |
| JP | 3245625 | | 11/2001 |
| JP | 2003149863 | A * | 5/2003 |
| JP | 2005-309246 | | 11/2005 |
| JP | 2007332192 | A * | 12/2007 |
| JP | 2008-39865 | | 2/2008 |
| JP | 4105151 | | 4/2008 |
| JP | 2008-155167 | | 7/2008 |

* cited by examiner

*Primary Examiner* — David Gray
*Assistant Examiner* — Francis Gray
(74) *Attorney, Agent, or Firm* — Oblon, Spivak, McClelland, Maier & Neustadt, L.L.P.

(57) ABSTRACT

A processing method of waste toner which is collected from an image forming device generated when an electrophotography image is formed, including: adding citrus oil to the waste toner.

9 Claims, 2 Drawing Sheets

PROCESSING METHOD OF WASTE TONER AND PROCESSING DEVICE OF WASTE TONER AND IMAGE FORMING DEVICE

CROSS-REFERENCE TO THE RELATED APPLICATION

The entire contents of Japanese patent application No. JP 2008-234925, filed on Sep. 12, 2008, of which the convention priority is claimed in this application, are incorporated hereinto by reference.

BACKGROUND OF THE INVENTION

1. Field of the Invention

The present invention relates to a processing method of waste toner which is capable of improving the handling property of the waste toner generated when an image of electrophotography from such as a copier and a printer is formed and collected by a cleaning process, and a processing device which enables such a processing, and an image forming device having such a processing device.

2. Description of the Related Art

In an image forming device of an electrophotography system, first, after charging a surface of a photoreceptor uniformly, an electrostatic latent image is formed by an exposure corresponding to a desired image. Next, a process in which the latent image is developed by toner in a developing device and is transferred to a piece of paper, and then the toner image is fixed, is performed.

And then, as disclosed by JP 2008-39865 A, toner remaining on the photoreceptor after the transfer process is collected by a cleaning process, and the waste toner is discharged to a detachable waste toner storage container 7 such as a toner bottle, and is discarded (refer to FIG. 3 of the present invention).

In addition, JP 2008-39865 A discloses storing waste toner in a limited space effectively, in which a mechanism such as a transport screw is attached (refer to FIG. 4 of the present invention), which results in high cost, and thus it is necessary to discharge the waste toner inside a container and reuse the waste toner container.

Waste toner generated after an electrophotography image is formed becomes finer compared with toner before being used, which is about 3-10 μm, and further minor powder of 1 μm or less is mixed, therefore fine particles fly in all directions when handling, and thus it is a serious work for a serviceman of an image forming device when carrying out maintenance or the like, and a handling operation is quite dirty, and is undesirable to an owner (a customer), etc., where the image forming device is set up.

Meanwhile, since there are pigments, resins, wax and polarity control agent, which are original components of toner mix, with silicon fine particles, which are an external additive or the like in the waste toner, dust occurs easily.

In addition, the resin property in toner made by a crushing method and that in toner made by a polymerization method is different, and in a case of an image forming device having a color image, there is a possibility that the toner made by the crushing method and the toner made by the polymerization method or the pigments are mixed, therefore it is necessary to take a countermeasure considering both of them.

Here, the following methods have been proposed as processing methods of waste toner which can improve the handling property of the waste toner.

JP 2008-155167 A proposes a technology of spraying a surface-active agent to waste toner, which makes it moist.

However, during the surface-active agent processing in this method, not all the waste toner can be treated, therefore there is a possibility that a sufficient effect might not be achieved.

In addition, although a processing method of waste toner in which the waste toner melts by heating, and then solidifies is proposed by JP 4105151 B, JP 2005-309246 A, and JP 2001-134010 A, problems arise such as a possibility of generation of poisonous gases to the human body by heating the waste toner, and generation of nasty smells and an unpleasant odor, in addition, security measures such as temperature control and overheating protection are needed during the processing, and thus a problem in that the processing cost increases is caused, as well.

Furthermore, JP 3245625 B and JP 3227199 B propose a method that adds degradable materials to promote degradation of binder components contained in waste toner, but the degradable materials can not correspond to all the toner processings, and the method is not a technology to improve the handling property of the waste toner either.

SUMMARY OF THE INVENTION

At least an object of the present invention is to provide, for example, a processing method of waste toner which is capable of being applied to the waste toner widely, and improving the handling property of the waste toner, without generation of nasty smells and harmful gas.

At least another object of the present invention is to provide, for example, a processing device in which the above-mentioned processing method of waste toner is carried out.

In addition, at least a further object of the present invention is to provide, for example, an image forming device including the above-mentioned processing device of waste toner.

In light of the above-mentioned, the present invention proposes, for example, a processing method of waste toner which is collected from an image forming device generated when an electrophotography image is formed, including: adding citrus oil to the waste toner.

The present invention further proposes, for example, a processing device of waste toner which uses the above-mentioned processing method of waste toner, including: a citrus oil tank which stores citrus oil; a waste toner storage part which stores the waste toner; and a citrus oil supply part which supplies the citrus oil from the citrus oil tank to the waste toner stored in the waste toner storage part.

The present invention further proposes, for example, an image forming device which includes the above-mentioned processing device of waste toner.

BRIEF DESCRIPTION OF THE DRAWINGS

The invention will be described further below with reference to exemplary embodiments and the accompanying schematic drawings, in which.

DETAILED DESCRIPTION OF THE PREFERRED EMBODIMENTS

Figure 1:
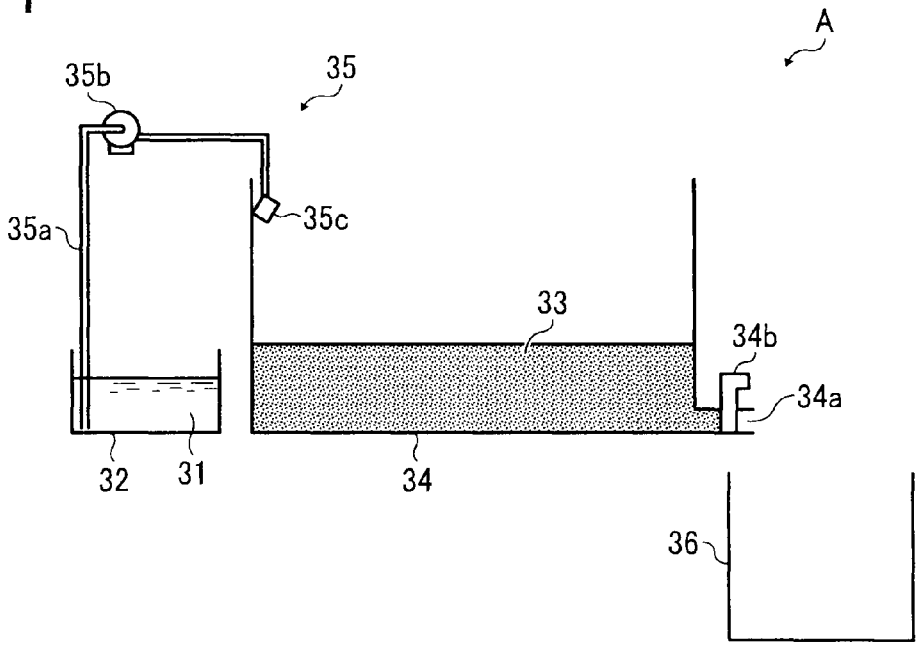
FIG. 1 is a model view illustrating an example of a processing device A using a processing method of waste toner with an improved handling property.

Oil used in the present invention is citrus oil. The citrus oil here is terpene hydrocarbon represented for example by d-limonene, and is an oily material with mild acidity (pH 3-6). Here, d-limonene is one kind of monocyclic monoterpenoid, the chemical formula of which is $C_{10}H_{16}$, and molecular weight of which is 136.23. Concretely, the citrus oil is essential oil obtained from the peel of citrus fruits such as orange, lemon, lime and grapefruit, and can be extracted from one kind or two kinds or more of the citrus fruits, especially orange oil extracted from an orange is desirable due to its great effect.

These citrus oils are included in the peel or the like of citrus fruits, and health problems will not be caused when handling.

As an additive amount of the citrus oil to waste toner, with respect to 100-weight units of the waste toner, 20-weight units or more is desirable, a range from 30-weight units to 80-weight units is preferable, and a range from 40-weight units to 80-weight units is particularly desirable. In addition, agitation during the addition and/or after the addition is desirable since a greater effect can be achieved earlier.

In the present invention, the citrus oil can contain, for example, plant essential oil such as flower oil, peppermint oil, spearmint oil and spice oil; oily extract (including coffee oil, etc.) such as kola-nut extract, coffee extract, vanilla extract, cocoa extract, tea extract and spices extract, and their oleoresin types; synthetic perfume compound and oily blending perfume composition or the like, within a range which will not exert any harmful influence on the effect of the present invention.

In the present invention, to improve the shelf life of the citrus oil, other organic solvents, chelating agents, enzymes, alkaline agents (one to produce an oxidation salt), oxidant ($O_2$ system), colorants or herbal components, squalan, siloxane, vegetable fats and oils, hyaluronan, collagen, elastin, retinol, tocopherol, ceramide, paraffin, albumin hydrogenerated oil, polyhydric alcohol (PG, PEG, glycerin, DPG, 1.3 BG and sorbitol), and polysaccharide (xanthan gum, β-glucan, CMC, cyclodextrin, metolose (trade name, made by Shin-Etsu Chemical Co., Ltd., Japan), mannan and guar gum), etc., can be added accordingly.

Here, a reason why the generation of dust can be suppressed effectively by liquidizing the entire toner with the citrus oil can be considered as follows.

D-limonene (a structural formula of which is illustrated by Chemical Formula (1)) has a similar molecular structure to that of styrene, therefore, it is considered that a main component of the toner, i.e. polystyrene (a structural formula which is illustrated by Chemical Formula (2)), dissolve readily in d-limonene, and further the solubility of d-limonene with an aromatic system compound which has a benzene ring be high, and therefore, the effect of the present invention can be achieved.

Chemical Formula (1)

(1)

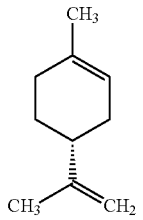

Chemical Formula (2)

(2)

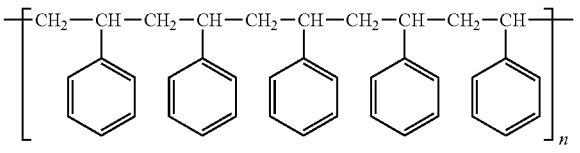

Due to this, in the present invention, the handling property is improved by liquefaction, therefore it is not associated with the generation of heat or melting by heat or the like, which is a concern when components of the toner change into other materials by a chemical reaction, and safety is also high.

Thus, the waste toner in a liquid state can be poured into any container by using its flowability, in addition, the citrus oil evaporates when the waste toner is left at room temperature, and afterwards the waste toner changes to a solid state, therefore handling is easy. Further, there is no need to worry about the environmental impact accompanying disposal of the citrus oil since it is harmless.

In the present invention, the addition of the citrus oil to the waste toner is performed by stirring the citrus oil with a bubble machine to bring air into the citrus oil and then supplying the bubbled (mousse form) citrus oil generated to a waste toner container where the waste toner is stored, or by supplying atomized citrus oil with such as a pressure type atomization nozzle (a nozzle which ejects outside liquid after rotating liquid current and atomizes the liquid) to the waste toner container where the waste toner is stored, therefore the citrus oil and the waste toner are brought into contact evenly, and thus the handling property is improved.

Here, an example A of a processing device of waste toner using such a processing method of waste toner with improved handling property is illustrated in FIG. 1.

The processing device A includes a citrus oil tank 32 which stores citrus oil 31, a waste toner storage part 34 which stores waste toner 33, and a citrus oil supply part 35 which supplies the citrus oil 31 from the citrus oil tank 32 in a form of mist directly above the waste toner 33 stored in the waste toner storage part 34, the citrus oil supply part 35 having a pipe 35*a*, an electric pump 35*b* and a pressure type atomization nozzle 35*c*. A taking out opening 34*a* is provided at a side bottom of the waste toner storage part 34, and the taking out opening 34*a* is closed with a cock 34*b* as illustrated in FIG. 1.

The misty citrus oil 31 is supplied to the waste toner 33 stored in the waste toner storage part 34 by the citrus oil supply part 35, and for example, after leaving it for a few minutes to tens of minutes, the liquidized waste toner runs out from the taking out opening 34*a* of the waste toner storage part 34 when the cock 34*b* is opened, and is collected by a collection container 36. After the collection ends, the cock 34*b* is closed again.

Thus, the waste toner 33 is collected extremely easily, without generation of dust.

In addition, it is preferable to attach such as a screw type stirring device for promoting the liquefaction, or a waste toner carrier device to the waste toner storage part 34, and in this case, waste toner attached to the screws is liquefied as well, therefore the waste toner can be recovered rapidly and easily without requiring any special mechanism, even if a screw with a complex configuration is used.

Moreover, an example in which an electric pump is employed as a pump which is used as the citrus oil supply part 5 in the processing device A is explained, in which a manual pump can be used. Further, it is possible for a flexible container to be used as the waste toner storage part 34, and the citrus oil 31 is supplied to the waste toner 33 from a shower head 35*c* by pressing the container with the hand, without using a pump, and in this case, the waste toner storage part 34 itself constitutes a part of the citrus oil supply part 35.

Figure 2:
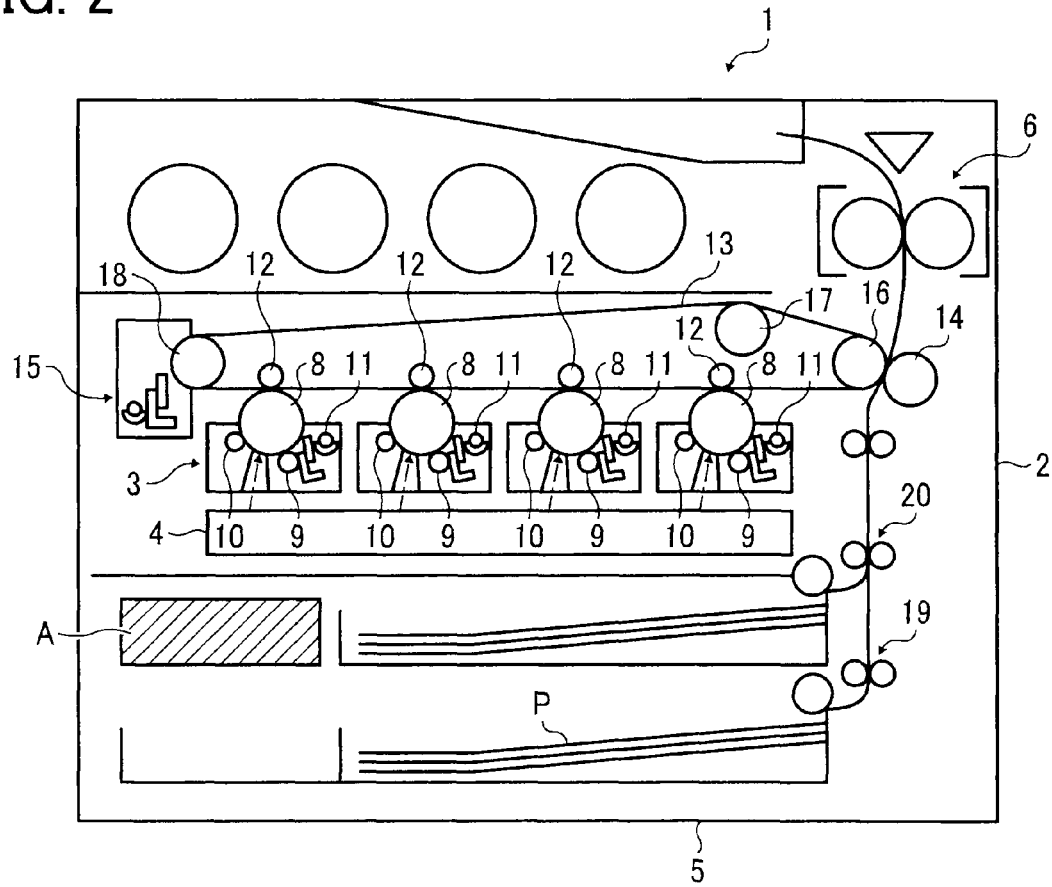
FIG. 2 is a model view illustrating an example of an image forming device which is provided with the processing device A according to the present invention.
Figure 3:
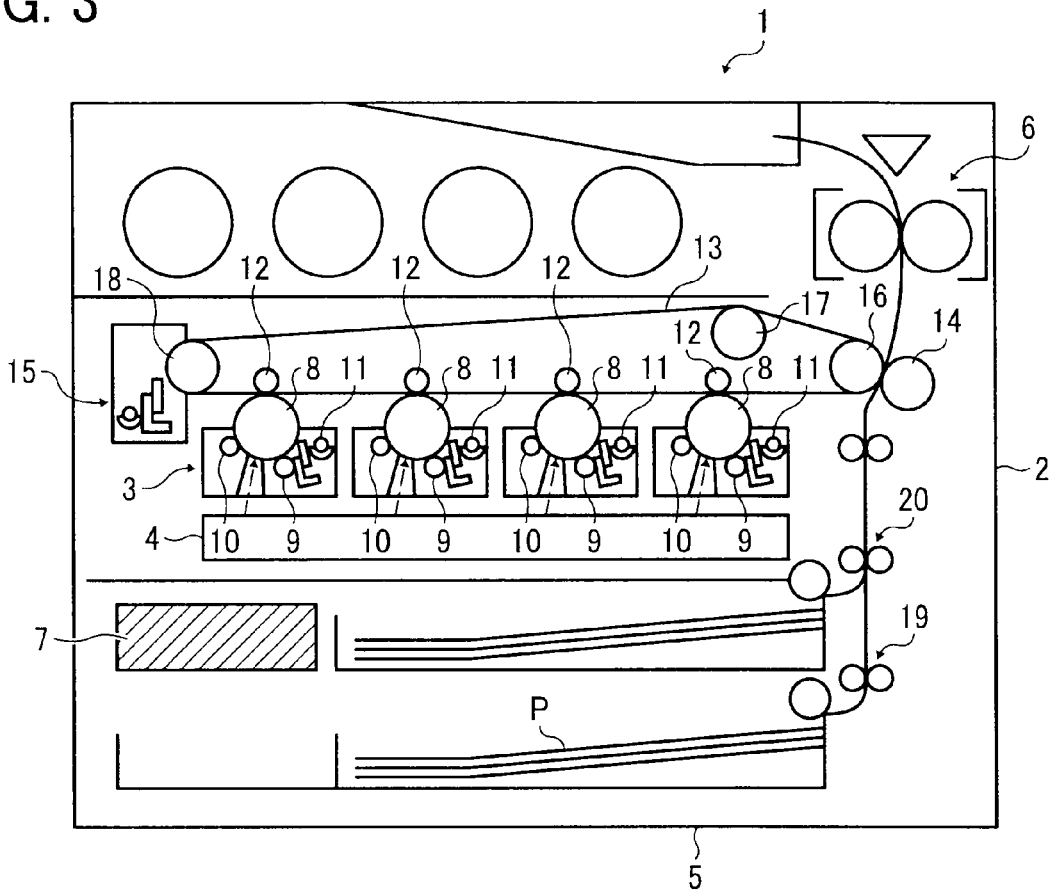
FIG. 3 is a model view illustrating an image forming device according to a conventional technology having a waste toner storage container.
Figure 4:
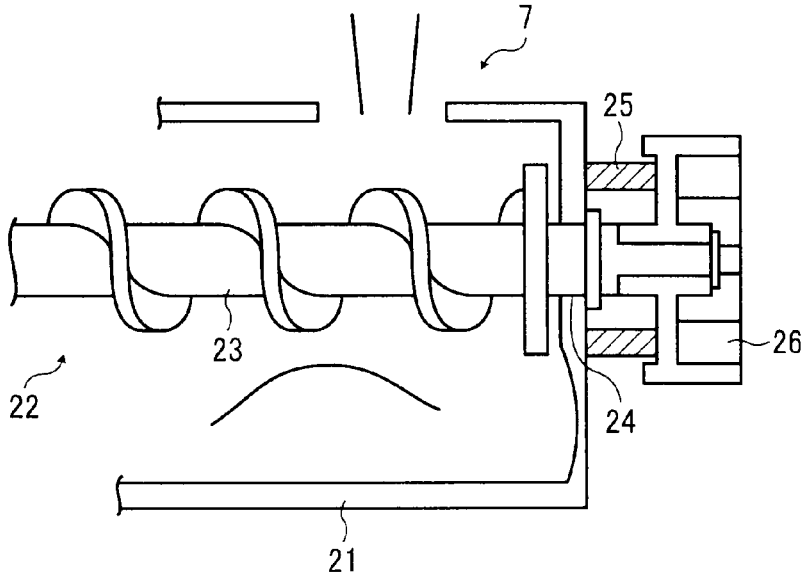
FIG. 4 is a model view illustrating the conventional waste toner storage container which is attached with mechanisms such as a transport screw.

Such a processing device can be provided separately, and as well it can be provided by replacing with a waste toner storage part in a conventional image forming device. FIG. 2 illustrates an example 1 of an image forming device which is provided with such a processing device A.

FIG. 1 is a vertical cross-section view illustrating a schematic structure of a color printer as an image forming device according to the present invention. As illustrated in FIG. 1, in a main body case 2 of a color printer 1, a printer engine 3, an optical writing device 4 which emits a light beam, a paper feed cassette 5 as a record medium storage part where a recording medium P which is a body to be transferred is stored, a fixing device 6 which performs a fixing processing on the recording medium P where a toner image has been transferred, and a waste toner collection container 7 where waste toner collected by a cleaning device 11 or the like after the toner image is transferred is stored, or the like are provided.

The printer engine 3 is a part where the toner image is formed and the toner image formed is transferred to the recording medium P, and is provided with four photoreceptors 8 (8Y, 8C, 8M, 8K) which are image carriers, at the circumference of each of the photoreceptors 8 being provided with a charging roller 9, a developing device 10 and the cleaning device 11, an intermediate transfer belt 13 which is an image carrier and a body to be transferred, four primary transfer rollers 12 each of which is arranged to abut to a corresponding photoreceptor 8 through the intermediate transfer belt 13, a secondary transfer roller 14 which transfers a transferred image on the intermediate transfer belt 13 to the recording medium P, and a cleaning device 15 which collects residual toner on the intermediate transfer belt 13.

Each of the photoreceptors 8 is in a cylinder shape, and is connected to a drive motor not illustrated in the figure, and rotates around a center line by a drive force from the drive motor. A photosensitive layer where an electrostatic latent image is formed is provided at an outer peripheral surface of each of the photoreceptors 8.

Each of the charging rollers 9 is arranged to abut to the outer peripheral surface of the corresponding photoreceptor 8, or is arranged to have a minute clearance from the outer peripheral surface of the corresponding photoreceptor 8. By applying each of the charging rollers 9 with a voltage from a power supply part (not illustrated in the figure), corona discharge is generated between each of the charging rollers 9 and the corresponding photoreceptor 8, and the outer peripheral surface of each of the photoreceptors 8 is charged uniformly.

The optical writing device 4 emits a light beam corresponding to image data, and exposes the outer peripheral surface of each of the photoreceptors 8 charged uniformly. An electrostatic latent image corresponding to the image data is formed on the outer peripheral surface of each of the photoreceptors 8 by this exposure.

Each of the developing devices 10 supplies toner to the corresponding photoreceptor 8. The toner supplied adheres to the electrostatic latent image formed on the outer peripheral surface of each of the photoreceptors 8, and the electrostatic latent image on the outer peripheral surface of each of the photoreceptors 8 is developed as a toner image.

The intermediate transfer belt 13 is a belt in the form of a loop, formed with a resin film or rubber as a base, and is wound around a drive roller 16, an entrance roller 17 and a tension roller 18, and rotates for example in a left direction in the figure by rotation driving of the drive roller 16 which is connected to a driving motor (not illustrated). The entrance roller 17 and the tension roller 18 are driven to rotate by frictional force with the intermediate transfer belt 13 by rotation of the intermediate transfer belt 13.

Each of the primary transfer rollers 12 is arranged on an inner side of the intermediate transfer belt 13 (inside of the loop), and the toner image on each of the photoreceptors 8 is transferred to the intermediate transfer belt 13 by applying a voltage for transferring to these primary transfer rollers 12. The toner image formed on each of the photoreceptors 8 is transferred to the intermediate transfer belt 13 sequentially and overlapped, and then a color toner image is formed on the intermediate transfer belt 13.

Each of the cleaning devices 11 cleans the outer peripheral surface of the corresponding photoreceptor 8 after the toner image is transferred to the intermediate transfer belt 13. By the cleaning, toner and paper powder or the like that remain on the outer peripheral surface of each of the photoreceptors 8 after the toner image is transferred to the intermediate transfer belt 13 are collected, as waste toner.

The color toner image formed on the intermediate transfer belt 13 is transferred to the recording medium P, by applying the voltage for transferring to the secondary transfer roller 14 at a timing when the recording medium P is sent to a transfer position where the intermediate transfer belt 13 abuts to the secondary transfer roller 14. The recording medium P is fed from the paper feed cassette 5 and is conveyed by a transport roller 19 and a resist roller 20, and is sent to the fixing device 6 after the toner image is transferred. The recording medium P to which the toner image is transferred is applied with heat and pressure and is subjected to a fixing processing in the fixing device 6, and then toner formed the toner image melts and the toner image is fixed to the recording medium P by the fixing processing. The recording medium P after being subjected to the fixing processing is fed to a paper receiving tray provided at an upper surface part of the main body case 2.

The cleaning device 15 cleans the outer periphery surface of the intermediate transfer belt 13 after the color toner image is transferred to the recording medium P. By this cleaning process, toner and paper powder or the like that remain on the outer peripheral surface of the intermediate transfer belt 13 after the toner image is transferred are collected as waste toner. The waste toner collected by the cleaning devices 11 and 15 is poured in the processing device A and is accumulated there.

Such a collection of waste toner from the image forming device can be carried out extremely easily, without generation of dust, i.e., without polluting the inside of the image forming device and its surroundings, and an operator's hands, and in addition, without requiring detaching of the processing device A from the image forming device or changing it.

Embodiment

Example 1

With respect to 100 g of waste toner accumulated in the color image forming device, 30 g of grapefruit oil ("Frances Murphy" massage oil leg grapefruit, made by "Tree of life" Co., Ltd) is added dropwise with a dropper over the entire waste toner evenly, and then agitated. At this time, it takes three minutes for liquefaction of the waste toner without generation of dust of the waste toner. Moreover, different from a conventional solidification processing by melting of waste toner, no unpleasant odor is generated (similar to the followings).

The waste toner liquidized as described above is poured into a palette mold and is left for one day at room temperature. And after the grapefruit oil is evaporated, it becomes a solid which can be easily handled. In addition, dust is not generated during these operations, and there is no contamination of worker's hands and clothes either.

Example 2

Similar operations to Example 1 are performed in Example 2, but 60 g of grapefruit oil is used, and then it takes two minutes for liquefaction of the waster toner, i.e. the liquidizing processing of the waste toner is completed more rapidly. The waste toner liquidized like this is poured into a palette mold and is left for one day at the room temperature, then it becomes a solid which is easy to be handled. In addition, dust is not generated during these operations, and contamination of worker's hands and clothes is not caused either.

Example 3

Similar operations to Example 1 are performed in Example 3, but 15 g of grapefruit oil is used, and then it takes five minutes for liquefaction of the waster toner, i.e. a time necessary for the liquidizing processing of the waste toner is long. The waste toner liquidized like this is poured into a palette mold and is left for one day at the room temperature, and then it becomes a solid which is easy to be handled.

Example 4

Similar operations to Example 1 are performed in Example 4, but 45 g of grapefruit oil is used, and then it takes two and a half minutes for liquefaction of the waster toner, i.e. comparing with Example 1, the liquefaction of the waste toner is completed rapidly. The waste toner liquidized like this is poured into a palette mold and is left for one day at the room temperature, and then it becomes a solid which is easy to be handled.

Example 5

Similar operations to Example 1 are performed in Example 5, but 90 g of grapefruit oil is used, and then it takes one minute for liquefaction of the waster toner, i.e. comparing with Example 1, the liquefaction of the waste toner is rapid. While when the waste toner liquidized like this is poured into a palette mold and is left at the room temperature, it takes two days to become a solid.

Example 6

Similar operations to Example 1 are performed in Example 6, but the addition method is changed, i.e. in Example 6, grapefruit oil is added in a foam (mousse form) which is formed by agitation to take in air, and then it takes two and a half minutes for liquefaction of the waster toner, the liquidizing processing of the waste toner is completed more promptly.

Example 7

Similar operations to Example 1 are performed in Example 7, but instead of 30 g of grapefruit oil used in Example 1, 30 g of orange oil ("Frog" (trademark) orange multi-cleaner) is added, and then it takes two minutes for liquefaction the waster toner, the handling of the waste toner is completed more smoothly.

Example 8

With respect to waste toner in a waste toner container of a color image forming device in which 300-500 g of waste toner generates every week, 50 g of orange oil ("Frog" (trademark) orange multi-cleaner) is atomized and then added twice a week regularly, and after liquefaction, the waste toner liquidized is collected from a pipe provided at a bottom of the waste toner container. In this case, the operation is easy and no contamination due to the waste toner occurs in the image forming device surroundings, and exchange of the waste toner container is unnecessary.

According to an aspect of the present invention, a processing method of waste toner of the present invention can be applied to waste toner widely, and by this processing method, there is no concern of generation of nasty smells and harmful gas, and the handling property of the waste toner can be improved safely and easily.

According to a preferable embodiment of the present invention, by a processing method of waste toner of the present invention, generation of dust during handling can be prevented more effectively, and handling is easy due to liquefaction of waste toner.

According to another preferable embodiment of the present invention, by a processing method of waste toner of the present invention, generation of dust during handling can be suppressed in a shorter time and more effectively, and handling property can be improved.

According to another aspect of the present invention, in a processing device of the present invention, the above-mentioned processing method with improved handling property of waste toner can be easily performed.

According to a further aspect of the present invention, in an image forming device of the present invention, waste toner can be collected without generation of dust, therefore an operation is easy, and contamination by the waste toner in a vicinity of an installation place can be prevented preliminarily.

It should be noted that although the present invention has been described with respect to exemplary embodiments, the invention is not limited thereto. In view of the foregoing, it is intended that the present invention cover modifications and variations provided they fall within the scope of the following claims and their equivalent.

What is claimed is:

1. A processing method of waste toner, comprising:

collecting waste toner from an image forming device in a waste toner storage part, and adding citrus oil to the waste toner in the waste toner storage part.

2. A processing method of waste toner according to claim 1, wherein with respect to 100-weight units of the waste toner, 20-weight units or more of the citrus oil is added.

3. A processing method of waste toner according to claim 1, wherein the citrus oil is added in a foam or in a form of mist.

4. A processing method of waste toner according to claim 1, wherein the citrus oil is orange oil.

5. A processing device of waste toner which uses a processing method of waste toner according to claim 1, comprising:

a citrus oil tank which stores citrus oil;

a waste toner storage part which stores the waste toner; and a citrus oil supply part which supplies the citrus oil from the citrus oil tank to the waste toner stored in the waste toner storage part.

6. An image forming device, comprising a processing device according to claim 5.

7. A processing method of waste toner according to claim 1, wherein the citrus oil is added to the waste toner with a pressure type atomization nozzle.

8. A processing method of waste toner according to claim 1, wherein the citrus oil contains air when added to the waste toner.

9. A processing method of waste toner according to claim 1, further comprising recovering the waste toner from the waste toner storage part.

* * * * *